US005527197A

United States Patent [19]

Evans

[11] Patent Number: 5,527,197

[45] Date of Patent: Jun. 18, 1996

[54] ARTICULATED ATTACHMENT MEANS FOR SWIMMING FIN

[76] Inventor: Robert B. Evans, 28 Anacapa St., Santa Barbara, Calif. 93101

[21] Appl. No.: 342,575

[22] Filed: Nov. 21, 1994

[51] Int. Cl.[6] ..... A63B 31/11

[52] U.S. Cl. ..... 441/64

[58] Field of Search ..... 441/55–64; 36/134

[56] References Cited

U.S. PATENT DOCUMENTS

| | | | |
|---|---|---|---|
| 2,784,503 | 12/1957 | Anderson | 36/59 |
| 4,944,703 | 7/1990 | Mosier | 441/61 |
| 5,041,039 | 8/1991 | Chang | 441/64 |
| 5,326,296 | 7/1994 | De Jesus | 441/61 |

FOREIGN PATENT DOCUMENTS

| | | | |
|---|---|---|---|
| 1666132 | 7/1991 | U.S.S.R. | 441/57 |
| 94/09859 | 5/1994 | WIPO | 441/64 |

*Primary Examiner*—Sherman Basinger

[57] ABSTRACT

A swim fin having manually articulable water-channeling vanes. A swim fin attachable to a human extremity such as a foot has a front portion through which a plurality of holes are present. Circumscribing these holes are corresponding clock washers that provide intermittent stops when engaged by a complementing clock washer. Such a complementing clock washer is present in a water channeling vane that is affixed over the clock washers of the swim fin by a bolt that passes into a bore (which may be threaded) within the vane. Upon full threading of the vane upon the bolt, the complementing and opposing clock washers come into close contact with one another whereby the ridge of one clock washer fits into a corresponding furrow of the other. The vane is then temporarily locked into place with respect to the swim fin, however this temporary lock is overcome by rotational pressure generally available from a human hand. An alternative embodiment, the swim fins may be retrofitted for affixation of such water channeling vanes by means of a template in which holes are present that correspond to the appropriate position for holes in the swim fin. Clock washers may be attached as by adhesive to the swim fin, or may contact the swim fin through mutually roughened or knurled surfaces to increase the friction therebetween. In use, the vane can be adjusted in any direction by turning the vane with respect to the swim fin.

12 Claims, 6 Drawing Sheets

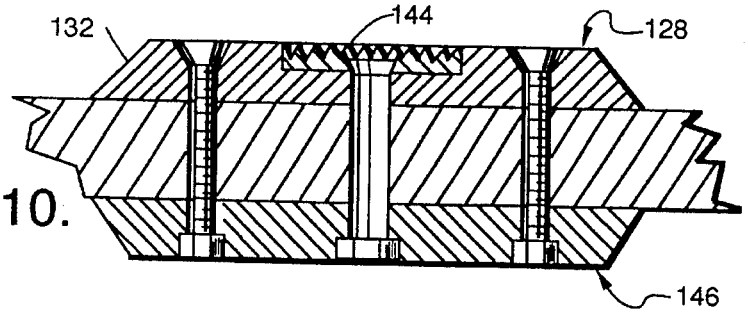
Fig. 10.
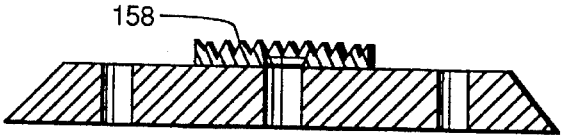
Fig. 11.
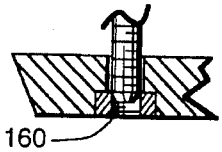
Fig. 12.
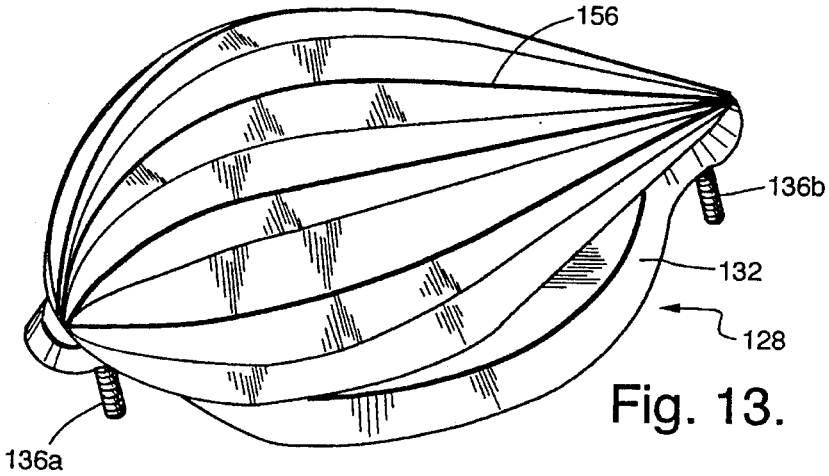
Fig. 13.
Fig. 14.
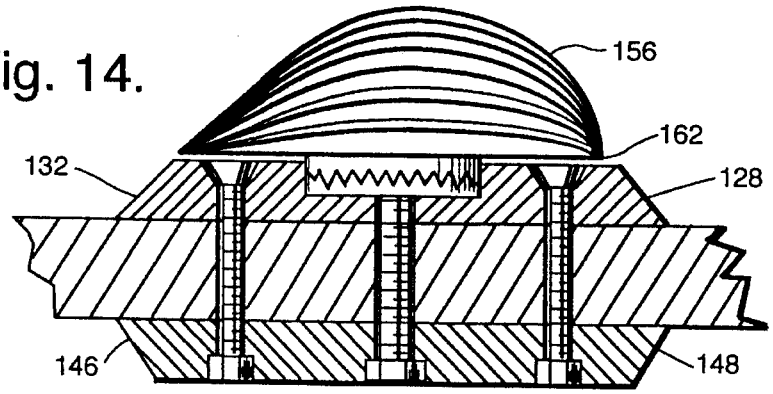

ARTICULATED ATTACHMENT MEANS FOR SWIMMING FIN

CROSS-REFERENCE TO RELATED APPLICATIONS

This application is an improvement upon International Application number PCT/US92/09002 having an international filing date of Oct. 26, 1992. Said application is incorporated herein by this reference thereto.

BACKGROUND OF THE INVENTION

1. Field of the Invention

This invention relates to swimming fins, and more particularly to water channeling vanes attachable to such swim fins whereby the flow of water about the fin can be usefully controlled and altered.

2. Description of the Related Art

Until the development of the swim fin having multiple interchangeable components of the parent application, no swim fins were known that could be made more resistive or more propulsive or both, depending upon the swimmer's needs. In the parent application, such swim fins were disclosed that carried water-channelling vanes that directed and controlled the flow of water about the fin. However, as shown in FIGS. 3*a*, 3*b*, and 3*c* of the parent application, the means by which the water channeling vanes of the parent application were connected to the swim fin blade were very static in nature and difficult to adjust manually while being worn in the water.

This lack of adjustability prevents minor but significant adjustments of the vane so that the water about the swim fin may be channeled in an easily selectable manner. Without such adjustment, the person wearing the fins may be forced to endure forces or stresses from the swim fin that might be better distributed or directed elsewhere.

Furthermore, if the swim fin is used for more than one individual, different individuals will have different preferences with respect to the attitude of the water-channeling vanes. Particularly, when used in hydrotherapy, a therapist may have a single set of fins that is used by a number of individuals. Making the vanes more easily adjustable will enhance and improve the hydrotherapy sessions for both the therapist and the patient.

Also, the swim fin with the water channeling vanes may be used under a variety of circumstances that require adjustment of the vanes. Without the ability to easily adjust such vanes, the utility and advantageous nature of the vaned swimming fin is reduced.

For these and other reasons, there is a need for modifying the swim fins in the parent application such that they are more easily adjustable in a convenient manner.

SUMMARY OF THE INVENTION

The present invention provides easily adjustable water channeling means for swim fins. A swim fin attachable to an extremity such as a person's foot has a front portion about which a series of holes are present at the vertices or at other useful locations. The holes allow bolts or other attachment means to pass through them to attach water channeling vanes to the swim fin. In order to prevent slipping of a water vane with respect to the swim fin, and also to provide means by which the water channeling vane can be movably held in place, a series of opposing and engaging stop means such as ridges are disposed between the water channeling vane and the swim fin. Once secured to the swim fin, the water channeling vane can be articulably and pivotally rotated with respect to the swim fin, with individual positions of the vane controlled by the detent-like movement of the vane with respect to the swim fin.

Preferably, a clock or timing washer provides an intermittent stop means by which the water channeling vane can be moveable positioned in a position-retaining manner. Once set into place, the water channeling vane is not easily displaced from its chosen position. The increased surface area of the ridged washers and the ridges themselves provide the present invention with its position-retaining ability.

Generally, the ridged contact surface of the water channeling vane is integral to it, the ridges being cast or molded in a one piece unit conjoined with the vane. With respect to the swim fin, its clock or timing washer can be integrally cast or molded with the swim fin, or individual clock washers can be used on the top and bottom sides of the swim fin. Use of individual clock washers is contemplated in conjunction with retrofitting a swim fin with the vanes of the present invention.

In order to allow easy retrofitting of a swim fin, thereby allowing use of the present invention, a template is used to establish the correct hole positions for the vane-attaching bolt. Generally, the template matches the blade portion of the swim fin and has one portion that fits within the foot channel of the swim fin so as to correctly position the template.

Upon installation, the water channeling vane is adjustable by taking it in hand and twisting it clockwise or counterclockwise until the correct vane position is established. The engaged ridges of the clock washers serve to hold the vane in place until repositioned again by the swimmer's hand.

From the above, it can be seen that an object of the present invention is to provide adjustable means for water channeling vanes in a swim fin.

It is another object of the present invention to provide such adjustable water channeling vanes that are easily adjustable.

It is another object of the present invention to provide easily adjustable vane means for a swim fin that are easily constructed.

It is a further object of the present invention to provide means by which a swimming fin that otherwise has no water channeling vanes can be retrofitted to bear such vanes.

These and other objects and advantages of the present invention will be apparent from a review of the following specification and accompanying drawings.

BRIEF DESCRIPTION OF THE DRAWINGS

FIG. 10 is a side cross-sectional view of the mounting plates of FIGS. 8 and 9 used in attachment to the swim fin of FIG. 7 taken along line 10—10 of FIG. 7.

FIG. 11 is an alternative embodiment of the mounting plate of FIG. 8 showing an exposed and protruding clock washer portion.

FIG. 12 shows a recessed nut structure that may be used in conjunction with any of the mounting plates disclosed herein.

FIG. 13 is a top perspective view of the speed pod that may be used in conjunction with the present invention.

FIG. 14 is a side partial cross-section of a speed pod mounted to mounting plates as shown in FIGS. 8 and 9, the mounting plate construction shown in cross-section.

DESCRIPTION OF THE PREFERRED EMBODIMENT(S)

The present invention resides principally in a swim fin having adjustable vanes for controlling the flow of water over and about the swim fin. The channeling of water over the swim fin provides means by which drag, propulsion, resistance and force can be constructively and directionally altered depending upon the desired operational characteristics of the swim fin.

Previously, adjustment of water channeling vanes was inconveniently achieved as a bolt attaching the vane to the blade of the swim fin had to be tightened sufficiently so that no movement of the water channeling vane could take place once the bolt was tightened down. While this tightly attached relationship between the swim fin blade and the vane prevented the vane from detaching from the blade, no adjustment of the vane with respect to the blade could occur. The present invention allows means by which such water-channeling vanes can be easily adjusted, yet will not be displaced by the flow, even very turbulent flow, of water over the swim fin.

Figure 1:
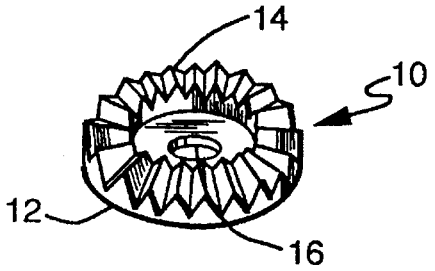
FIG. 1 shows a top perspective view of the clock or timing washer according to the present invention, the washer having a hole at its center.

As shown in FIG. 1, a clock or timing washer structure 10 provides the preferred means by which such adjustable positioning is achieved. The clock or timing washer 10 of FIG. 1 generally has a flat disk 12 upon which a series of ridges 14 circumscribe the perimeter. In the center of the disk, a hole 16 is created so that a bolt or other means of attachment may pass through the center of the clock washer. The ridges 14 of the clock washer may be angled inwardly so that the outermost edge of the ridges are taller than the innermost height of the ridges. This creates an indentation effect whereby the entire structure slopes towards the center and the hole 16. Alternatively, the ridges 14 may be uniform in height, or even angled outwardly so that the innermost edge of the ridges are taller than the outermost height of the ridges. In this sense, the angle of the ridges 14 may be respectively negative, neutral or positive. As the angels of the ridges may be selected, it can be seen that the ridge height closer to the center compare to the ridge height farther from center.

The same inward sloping effect (or similar alternative ridge configuration) may be used on a complementary and opposing clock washer so that the ends of the ridges are interengaged with the peaks of one washer nestled in the troughs of the other, and vice-versa. Alternatively, the complementary and opposing clock washer may be chosen or selected to only partially engage the ridges of the corresponding clock washer.

When the clock washers are made of resilient and flexible material, the engaged ends of the ridges can be flexed and temporarily deformed to allow rotation of the two complementing and opposing washers with respect to each other. Alternatively, only one clock washer need be made of resilient and flexible material. The corresponding clock washer may be rigid and inflexible as when constructed of hard plastic or metal. In such a case, one washer will supply the flexibility necessary to allow the vane to turn with respect to the swim fin.

Figure 4:
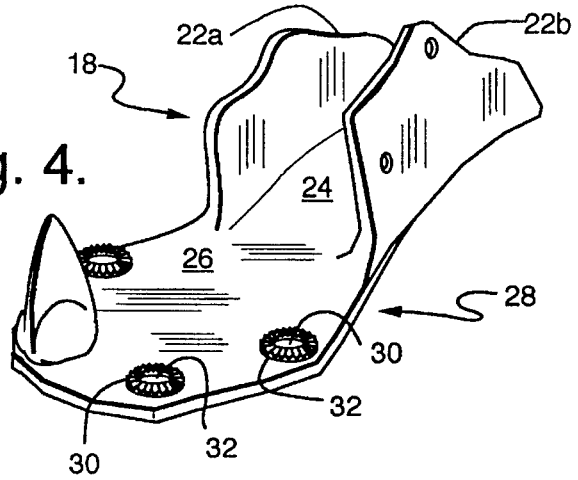
FIG. 4 shows a front side perspective view of a swim fin constructed according to the present invention. Shown are integral clock washers on the blade of the swim fin with a water channeling vane shown attached to the swim fin above a hidden clock washer.

The swimming fin of the present invention may be similar to that of the parent application, serial number PCT/US92/09002 with an international filing date of Oct. 26, 1992, that parent application is incorporated herein by this reference thereto. To briefly summarize that swimming fin as set forth in the parent application (shown in FIG. 4), a truncated swimming fin 18 has a tunnel or channel 20 for a swimmer's foot flanked on opposing sides by a pair of arcuate-shaped flaps 22*a, b*. Each arcuate-shaped flap has a pair of holes drilled therethrough through which a binding may be laced to thereby lash the swimming fin 18 on the person's foot.

Alternatively, and as set forth in more detail below, a swimming fin of conventional design may be retrofitted to include the vanes or winglets as set forth herein.

The arcuate-shaped flaps 22*a, b* flank the rear portion 24 of the swimming fin. From the rear portion 24, the swim fin 8 then flares out into the front portion or blade 26 generally parallel to the wearer's foot. The rear portion 24 may be roughly rectangular or otherwise shaped as is most useful or advantageous for the particular fin. In one embodiment, the front portion or blade 26 may be roughly trapezoidal, but in other embodiments may be of other useful or advantageous shapes. Together, the rear portion 24 and the blade 26 are the sole plate 28 of the swim fin 18. At the vertices of the front portion 26 are corresponding holes 30 that are circumscribed by an attachable 10 or integral 32 clock washer structure previously mentioned. Alternatively, holes 30 may be formed or drilled elsewhere on the fin 18 where the ability to attach a vane and thereby control the adjacent flow of water is desired. Further, other alternative means of attachment may be used to connect the vane to the swim fin. Clamps or adhesion as are known in the art may be used to connect the vane to the swim fin.

Figure 3:
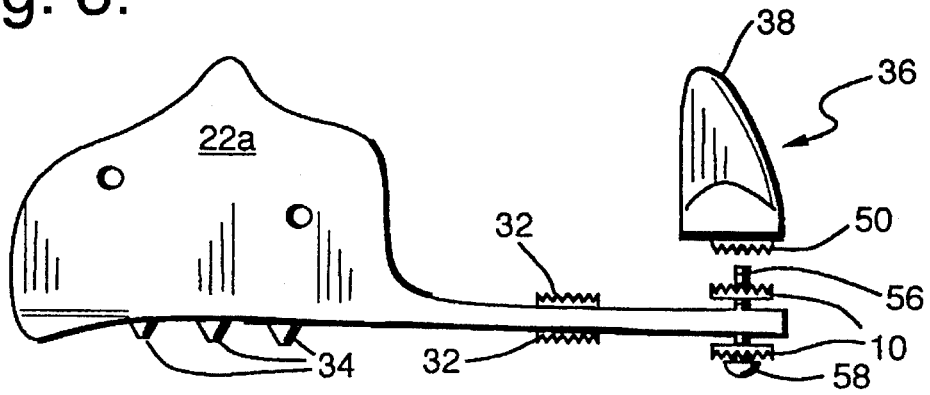
FIG. 3 shows a side elevational view of a swim fin constructed according to the present invention. The swim fin shown has both integral clock washers and attachable clock washers shown. The retrofit construction with attachable washers to include a water-channelling vane is at the far right.

The swim fin of the present invention is approximately a quarter of an inch thick and is made of known swim fin material such as rubber, polyurethane, silicones, or other such materials. As shown in FIG. 3, traction ribs or cleats 34 are provided by the swim fin 18 beneath the heel portion 24 of the swim fin. These protuberances may also be selectively located in known areas of drag resistance to create vortices that relieve such drag. Preferably, such protuberances are knob-like in nature.

Figure 2:
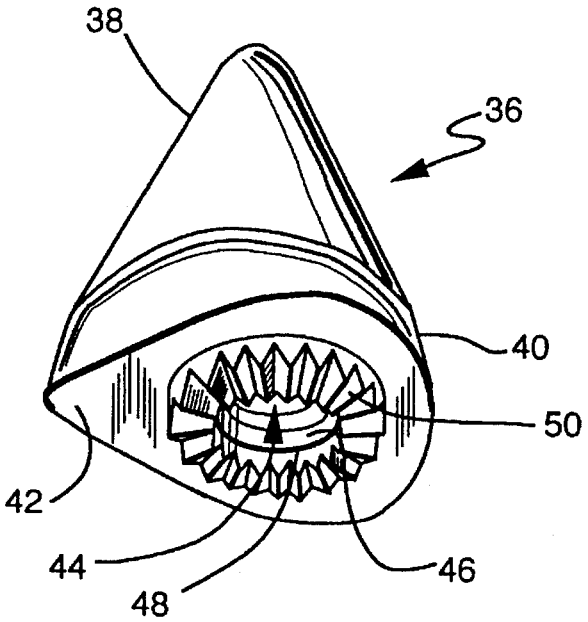
FIG. 2 shows a bottom perspective view of a water channeling vane according to the present invention showing the internally threaded bore with the integral clock washer circumscribing the aperture of the bore.

As shown in FIG. 2, the water channeling vane 36 of the present invention has a protruding water channeling portion 38 hereinafter referred to as the vane fin 38. Below the vane fin 38 and connected thereto is the body 40 of the vane, beneath which a flat surface 42 provides some clearance for the attached swim fin 18. Centrally located on the flat underside 42 of the vane 36 is a mounting hole or bore 44 which is preferably threaded. Threads 46 of the bore 44 match those of a bolt which may be used to attach the vane 36 to the swim fin 18. The bore 44 leads out from the core of the vane body 40 ending in an aperture 48 that is circumscribed by clock washer ridges 50. These ridges 50 provide intermittent stop means that are used to articulably control and position the vane 36 with respect to the swim fin 18.

As indicated by FIGS. 2. 15, and 16, the vane protrudes into the surrounding area in a manner generally parallel to the major axis of the associated bore.

Alternatively, when the vane is constructed of a strong, resilient material such as polyurethane, pre-threading of the bore may not be necessary. By providing a bore slightly smaller in diameter than the screw to be used to attach the vane to the swim fin, the material within the hole of the vane will conform to the threads of the screw. Similarly, the screw may cut its own threads into the vane bore when first driven into the vane.

Figure 5:
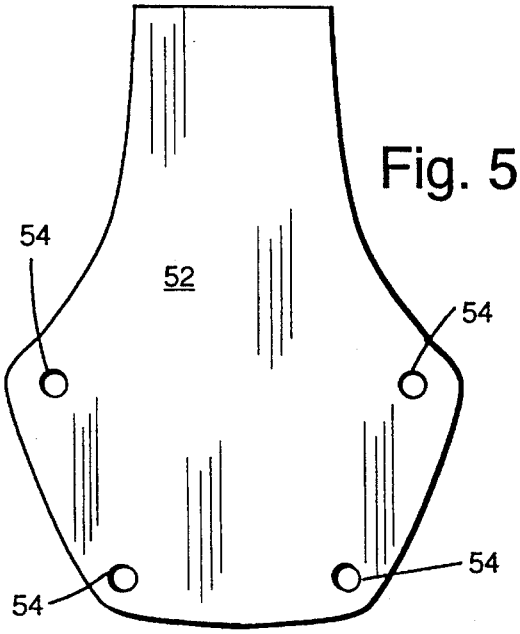
FIG. 5 is a top elevational view of a template according to the present invention.
Figure 6:
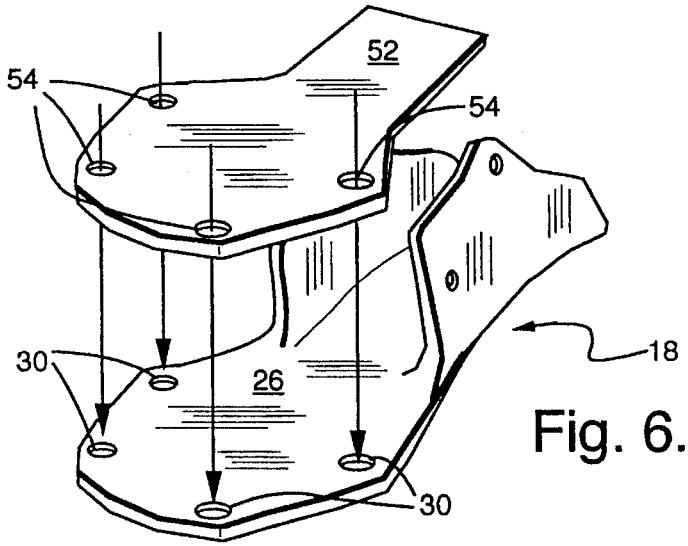
FIG. 6 is an exploded view of the template as used in conjunction with the swim fin of the present invention with arrows indicating the correspondence between the vertex holes of the template to those of the swim fin blade.

As shown in FIG. 5, a template 52 corresponds closely to the sole plate 28 of the swim fin 18. Holes 54 are present in the template 52 that correspond to the holes 30 in the blade 26. The template fits over the sole plate 28 of the swim fin 18 and as shown in FIG. 6, allows holes 30 to be properly positioned for drilling into the blade 26. As a drill bit will not generally be hindered in its passage through rubber, it is best to make a permanent template 52 out of a more resilient material such as metal or durable ceramic. However, for most consumer purposes, a temporary template is sufficiently adequate to convey the benefits of the present invention. Templates made of paper, Mylar, plastic, cardboard or other like material may be entirely acceptable for the positioning of the holes. Such templates may be left on the fin during drilling, or can be used to simply mark the location of the holes which are then drilled out.

Once the holes 30 have been drilled into the swim fin blade 26, clock washers 10, such as that shown in FIG. 1, can be used and attached to the swim fin blade 26. The clock washers 10 circumscribe the holes 30 drilled by the use of the template 52. As shown in FIG. 3, once the holes 30 have been drilled into the swim fin blade 26, the swim fin 18 is then ready for the attachment of the clock washers 10 and the vane 36. The right most portion of the drawing of FIG. 3 shows the attachment structure of the clock washers 10 and vanes 36 by means of a bolt 56 to the swim fin. As shown, the vane 36 is attached generally perpendicular to the plane of blade 26.

In order to ensure that the vane 36 pivots with respect to the corresponding swim fin clock washer 10, an adhesive or other friction enhancing material or structure (such as a knurled or roughened surface) can be used between the swim fin clock washer 10 and the swim fin blade 26. In this way, when the vane 36 is turned, the underlying swim fin clock washer 10 will not turn with the vane 36.

As shown in FIG. 3, a bolt 56 or other attachment means may be used to affix the vane 36 to the swim fin blade 26. The threads of the bolt 56 match the threads 48 of the vane 36, thereby connecting the vane 36 to the blade 18.

In order to construct a retrofitted swim fin, the template 52 is used as previously described, whereby the hole 30 positions are properly located when the template 52 is placed over the blade 26. The drill is then passed through the holes 54 of the template 52, drilling out the blade surface beneath the template holes 54. Surface roughening or knurling can then be created around the drilled out holes 30. If clock washers 10 are to be permanently affixed to the swim fin blade 26, an adhesive can be used between the clock washer 10 and the perimeter area circumscribing the holes 30 of the swim fin blade 26. Alternatively, surface knurling or roughening may provide enough friction between the clock washer 10 and the swim fin blade 26 to ensure that the clock washer 10 does not turn with the vane 36.

As shown in exemplary form in FIG. 3, a bolt 56 is passed through a first clock washer 10 with the ridges 14 of the clock washer 10 facing the bolt head 58. The bolt 56 is then passed through the swim fin blade 26 and a second clock washer 10. The ridges 14 of the second clock washer 10 face away from the bolt head 58 and toward the vane 36 with its complementing, integral clock washer ridges 50. The vane 36 is then threaded onto the bolt 56 until it comes into contact with the underlying blade clock washer 10. As shown in FIG. 3, clock washer structures may be present on both the upper and lower sides of the swim fin blade. If desired, a headless bolt (not shown) can be used that is threaded at both ends so that oppositely opposing vanes can be used on both sides of the swim fin blade. Alternatively, clock washer structures can be placed not only on both upper and lower sides of the swim fin, but on either the upper or lower side alone.

Once the swim fin blade has been retrofitted with the clock washers, it operates in the same manner as a swim fin with integrally constructed clock washers.

As for those clock washers 32 that are integrally constructed with the swim fin blade 26, once the bolt 56 is run through the blade hole 30, the vane 36 can be threaded onto the bolt 56 until it can no longer be easily turned onto the bolt 56 and there is snug contact and engagement between the ridges 32, 50 of the opposing clock washers. In the preferred embodiment, there are three hundred sixty degrees (360°) of rotation possible between the vane 36 and the swim fin 18.

When the vane 36 is turned (like a wing nut) upon the bolt 56, the complementing ridges tend to force the vane 36 and blade 26 away from one another, simultaneously flexibly deforming the interengaging ridges. Upon the application of sufficient force (generally available to a human hand), the clock washer ridges 50 of the vane 36 will shift over one position with respect to the clock washer ridges 32/14 of the swim fin blade 26. When the rotating force of the swimmer's hand is released, the vane 36 and its clock washer ridges 50 seat themselves on the swim fin blade 26 and its clock washer ridges 32/14 in very snug engagement.

While the clock washer ridges 14/32 may project above the surface of the structure to which they are attached, contemplation of recessed clock washers is also made. Such recessed clock washers allow for a flush surface between the vane 36 and the swim fin 18. Recessed clock washers can be safer when diving in environments where kelp, filaments, or other entangling strands or flora may be present in the water. Recessed clock washers suffer less drag than exposed clock washers, especially when a fin fitted for articulable water-channeling vanes is used without such vanes. Recessing the clock washers also prevents accidental abrasion from exposed surfaces (such as swimming pool surfaces, rocks or coral) when the clock washers are exposed due to removal of vanes.

Due to the strength of the force required to articulate the vane 36 with respect to the blade 26, it would be an unusual and infrequent occurrence for the flow of water to be able to create such a specifically directed force. As the present invention is contemplated for use in water and other fluids, the interengagement of the opposing clock washers provides sufficient means by which the vane can be held in place with respect to the swim fin blade. The detent-type movement between the vane and blade by means of the clock washers is both useful and elegant. A swimmer encountering such a device for the first time should not have difficulty putting it into use, allowing the swimmer to conveniently adjust the vanes of the fin according to present needs and/or wants.

Figure 7:
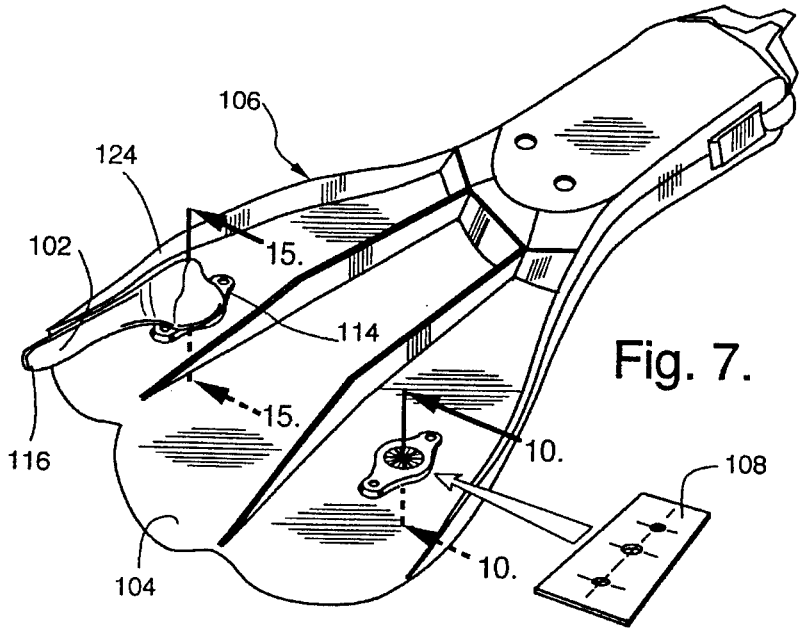
FIG. 7 is a perspective view of a conventional swim fin retrofitted by use of a template to bear a clock washer mounting plate and a winglet vane according to the present invention. Also shown is a template used to correctly indicate the holes drilled when retro-fitting the fin.

As shown in FIG. 7, the vanes of the present invention may take the form of winglets 102 that extend forwardly from the blade 104 of a swim fin 106. Such winglets may be retro-fitted to conventional or other accommodating swim fins by means of mounting plates (FIGS. 8, 9 and 17) bearing clock washers. The template 108 may be used to properly indicate the position where holes must be drilled through the swim fin blade 104 in order to accommodate the screws or bolts used to attach the mounting plates and the vanes or speed pods of the swim fin to be retrofitted. Such templates will generally have three holes: two for the screws or bolts attaching the pair of mounting plates to each other and one for the vane or speed pod. The vane or speed pod hole is centrally located in the mounting plate and between the other two holes.

Figure 15:
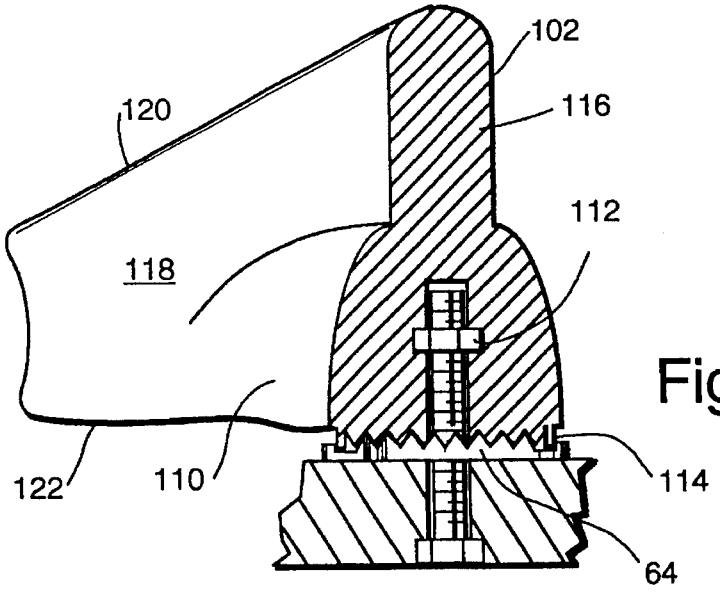
FIG. 15 is an end view of the winglet shown in FIG. 7, an interior portion of which is shown in cross-section generally along line 15—15 of FIG. 7.

As shown in FIGS. 7 and 15, the vane winglet of the present invention has a rounded, slightly protruding portion 110 to better engage the nut 112 encased within its interior and to provide initial streamlining to the oncoming flow of water. The vane winglet 102 may be attached at one end to a mid-portion of the underlying swim fin. The vane winglet 102 then extends in a streamlined manner towards the furthest reach of the swim fin blade.

The vane winglet 102 has a marked curvature as it approaches the attachment point 114 from its furthest extent 116. This curvature is present predominantly near the attachment end 114 of the vane winglet 102, with the greatest portion of the winglet travelling in a predominantly straight manner. The outer side 116 of the vane winglet closest to the side of the swim fin is latitudinally curved towards the inner side 118 of the vane winglet. The inner side of the vane winglet is predominantly perpendicular to the underlying swim fin, as is the outer side which establishes its curve generally towards the top 120 of the vane winglet. The longitudinal curve of the vane winglet near the attachment area 114 is curved inwardly towards the fin 106. Another slight curvature may be present towards the furthest extent of the vane winglet, the curvature being slightly outward and away from the fin.

The height of the vane winglet 102 is somewhat dependent upon the size of the fin and a larger vane winglet is needed where large amounts of water are moved by generally large swim fins having a large surface area. Correspondingly, where smaller fins move a smaller volume of water and such swim fins have a smaller effective area, smaller vane winglets are needed. Generally, the vane winglet 102 will stand above the swim fin 106 so as to effectively change the flow of the surrounding water stream. This generally means that the layers of water that adhere or that are effected by contact with a swim fin when water flows over the swim fin are negligible with respect to the water channeled by the vane winglet 102. Furthermore, the effect of the vane winglet 102 should be significant when compared to the entire flow of water generated by the kicking of the swim fin 106 by the swimmer.

As travel is made from the front portion of the vane winglet (near the point of attachment 114 to the swim fin) to the rear of the vane and furthermost extent of the vane winglet 116, the bottom of the vane winglet 122 tapers inwardly so as to create a thinner cross-section as the vane winglet 102 travels away from the point of attachment 114. The vane winglet also tapers at its end 116 somewhat upwardly at an angle slightly steeper than that of the downward taper from the top of the vane winglet 120. In general, water flowing past the vane winglet 102 first encounters a large structure where the vane winglet is attached to the swim fin 114 and then redirected in a turbulence-mediating manner by the tapering extension of the vane winglet 102.

Examples may be given of positions available for the vane winglet 102 as attached to a swim fin 106 as shown in FIG. 7. In a first position, the tapered vane winglet extension runs generally parallel to the side of the swim fin 124 with the front tapered end of the vane winglet 102 pointing inwardly towards the interior of the swim fin.

In a second position, the forward tapered end of the vane winglet 102 is parallel to the side of the swim fin 124 with the tapering rear extension of the vane winglet pointing in a direction inwardly towards the rear of the swim fin 106. This second position provides increased water channeling and direction centering to the water so that greater propulsive effect is created with each kick of the swimmer.

In a third position, the outer side of the tapered front end of the vane winglet 102 is generally parallel to the side of the swim fin 124, whereas in the second position the tapered end pointed in a direction parallel to the side of the swim fin. The tapered extension towards the rear of the vane winglet 116 points at an even greater angle towards the interior surface of the swim fin blade 104. This third position provides the greatest amount of thrust and propulsion to the swimmer with each kick.

Figure 17:
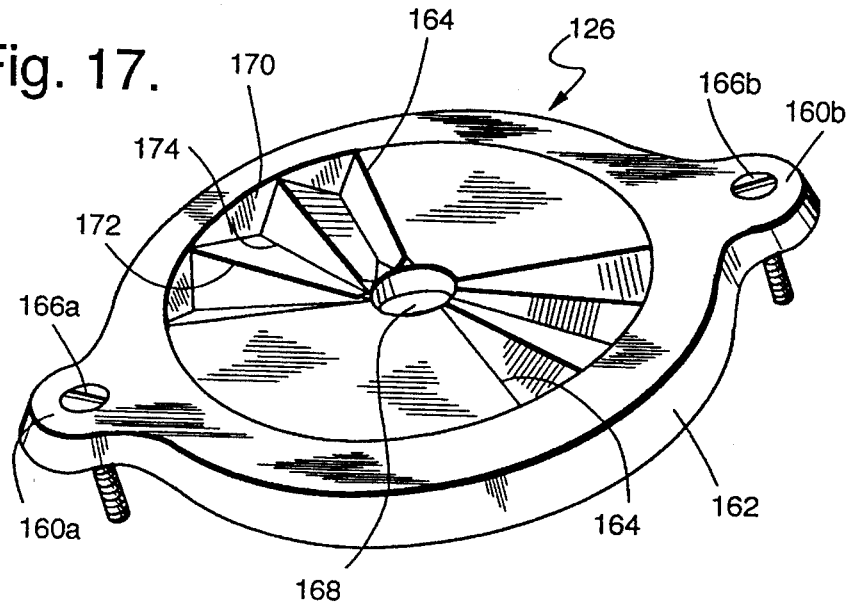
FIG. 17 shows a top perspective view of a washer mounting plate similar to that of FIG. 8 save that a reduced number of clock washer ridges is present to limit the angular displacement of an attached device such as a winglet.
Figure 18:
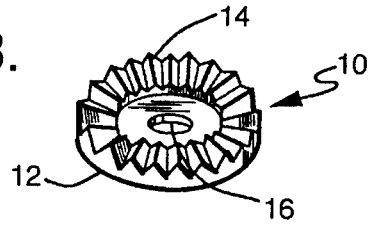
FIG. 18 shows a top perspective view of a clock or timing washer similar to that shown in FIG. 1 save that the ridges are slanted inwardly toward the center of the washer.
Figure 19:
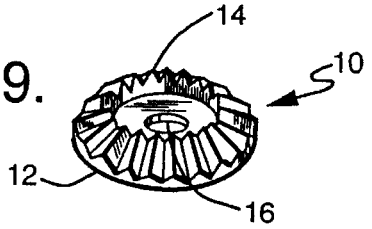
FIG. 19 shows a top perspective view of a clock or timing washer similar to that shown in FIG. 1 save that the ridges are slanted outwardly away from the center of the washer.

As shown in FIG. 17, 3-slotted clock washers 126 can be used to provide the 3-position articulable and discrete positioning for the vane winglet 102 with respect to the swim fin 106 as set forth above. Of course, readily available 360° clock washers could also be used although most of the available angles of the 360° clock washer could not be used.

Under some circumstances, the shape of the vane winglet 102 could be seen as similar to that of a whale with a broad front and a tapering rear, but without the transverse tail, making a turn by pivoting about its pectoral fins or what might be considered to be its "shoulders".

Figure 8:
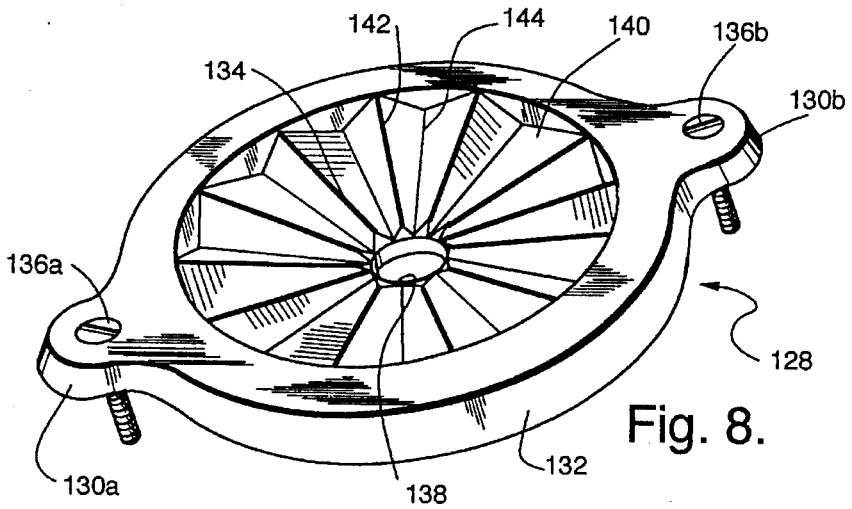
FIG. 8 is a perspective view of a washer mounting plate according to the present invention showing a recessed clock washer and attachment bolts.
Figure 9:
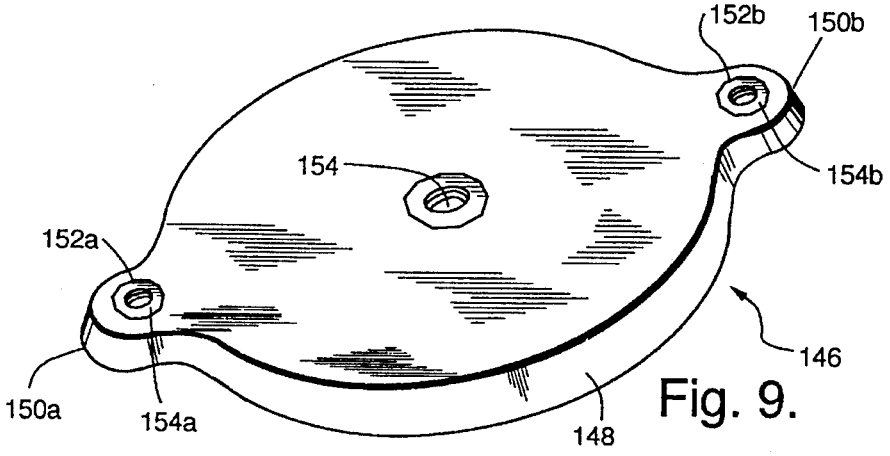
FIG. 9 is a perspective view of a outwardly facing side of a terminal mounting plate that operates in conjunction with the mounting plate of FIG. 8. Recessed nuts are shown at the center and at the ends of the terminal mounting plate.

FIGS. 8 and 9 show a corresponding pair of mounting plates as contemplating in the present invention. Beginning first in the mounting plate shown in FIG. 8, the generally circular plate 128 has lobed opposing ends 30*a, b*, a sloped perimeter and a recessed central portion 134. Holes are present central to the lobes (not shown) that allow the passage of screws or bolts 136*a, b* therethrough. Such screws or bolts 36 may be recessed into the lobes 130 or may protrude above the surface of the plate 128. Inside the central recessed portion 134 is a central hole 138 through which a screw may pass to connect a vane or speed pod to the swim fin 106. Encircling the circumference of the central hole and extending to the outward edges of the recess is a clock washer structure 140 with alternating peaks 142 and troughs 144. This clock washer structure 140 matches a similar structure in the attached vane or speed pod.

FIG. 9 shows a corresponding terminal mounting plate 146 that serves to hold the mounting plate 128 in FIG. 8 to the swim fin 106 and to provide a connection between the swim fin 106 and the attached vane 102, 36 or swim pod. Like the clock washer mounting plate 128 in FIG. 8, the terminal mounting plate 146 of FIG. 9 is generally circular in nature having a sloped perimeter 148 and opposing lobed ends 150*a, b* with holes central to the lobes 152*a, b* formed therethrough. Furthermore, there is a central aperture 154 corresponding to the similar one 138 in the washer mounting plate. These holes or apertures serve as means by which the bolts 136 of the washer mounting plate may pass through the terminal mounting plate 146 and be subsequently secured thereto by means of nuts 154*a, b* or the like.

The lobe nuts 154 of the terminal plate serve to connect the two mounting plates 128, 146 to the swim fin 106, establishing a stable foundation upon which the vane or speed pod can be mounted to the swim fin 106. A screw or bolt connected to the vane or swim pod is passed through the mounting plates and the swim fin between them. This screw is then fitted with a nut in order to secure the bolt and the attached vane or speed pod to the swim fin.

Figure 16:
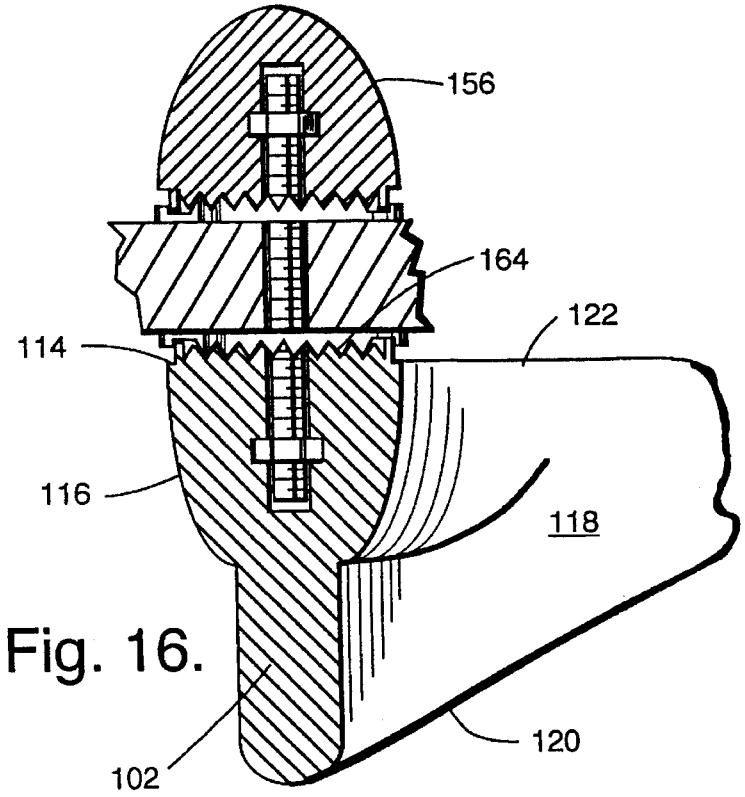
FIG. 16 shows in cross section the positioning of a speed pod and a vane winglet to a swim fin according to the present invention.

Alternatively, the use of a terminal mounting plate may not be necessary as a second clock washer mounting plate 128 may be used in opposition to a first one so that articulable structures may be installed on both sides of the swim fin. Such an arrangement is shown in FIG. 16 where a speed pod 156 and vane winglet 102 are shown on both sides of the swim fin 106. Under such circumstances, a long screw having no head may be used to connect the two structures on opposite sides of the swim fin 106 and mounting plates 128, 146.

FIGS. 10 through 14 show in cross-section a number of structures contemplated as a part of the present invention. FIG. 10 shows in cross-section the connection of the two mounting plates 128, 146 of FIGS. 8 and 9 on opposing sides of the swim fin blade 104. As shown in FIG. 10, the head of the bolts may be recessed, but it should be understood that in an alternative embodiment the heads may be exposed. Likewise, the bolts on the terminal mounting plate on the bottom side of the fin may have recesses for the bolts or, alternatively, the bolts may be exposed and protruding from the exterior of the terminal mounting plate.

In FIG. 11, the clock washer section 158 is exposed and protrudes from the exterior of the mounting plate 128. Under some circumstances, such a configuration may be of some advantage to a swimmer or a diver. FIG. 12 shows a recess 160 such as one that can be used to accommodate a nut or bolt head so that the nut or bolt head does not protrude from the exterior surface of or about the recess.

FIGS. 13 and 14 show a speed pod 156 used in conjunction with the mounting plates 128, 146 of the present invention. The speed pod 156 has a hemispherical cross-section on the lateral plane and an oval cross-section in a longitudinal plane so that the speed pod 156 has a pear or tear drop shape which protrudes from an exterior surface of the swim fin 106. The edges of the speed pod 162 may be formed so as to continue a slope initially present at the edges of the mounting plates 132. In this way, water flow may be affected by the speed pod 156 while minimizing turbulent flow arising from discontinuities present between the mounting plate 128 and the speed pod 156.

It is known that there is a dead spot in the middle of the underside of any fin. There may be other dead spots at other areas on a swim fin. Therefore, a speed pod 156 is also provided as part of this invention to alleviate drag or other resistance created by dead spots. The speed pod is shaped like a streamlined hemisphere: in other words it has a tear drop shape. The speed pod may be any convenient size and may be made from high density foam, or solid plastic. It can even be filled with a heavy material such as lead. Use of the speed pod, by diverting water from dead spots, will enable the swimmer to swim faster. The pod may be made of foam to keep the swimmer's feet high in the water. If the pod is made from a dense solid plastic or is filled with lead, it will make the swimmer's feet sink, thus making his legs work harder. Neutrally or almost neutrally buoyant speed pods may also be used.

As shown in FIG. 15, a nut 112 or other similar object is encased in the vane winglet 102. This encased nut 112 provides attachment means for the vane winglet 102 to the swim fin 106. When a bolt, screw or other similar object is passed through the mounting plates 128, 146, it can be threaded through the encased nut 112. When the other, free end of the bolt is secured, the vane winglet 102 or other attachment may then be secured to the swim fin 106.

Once the mounting plates 128, 146 have been installed, the vane winglet 102 can be threaded upon the bolt so that the clock washer structure 164 present on the vane winglet 102 can enmesh with that 140 of the clock washer mounting plate 128. When the bolt or screw is sufficiently tightened, the clock washers 140, 164 will snugly seat themselves against one another thus constraining the rotational movement of the vane winglet 102. As before with the simple vane fin 36, the clock washers allow articulated movement of the vane winglet 102 with respect to the swim fin 106 in discrete angular positions. In one embodiment, the clock washer structure on either or both the vane winglet and clock washer may have a limited number of ridges so that the angle through which the vane may turn is correspondingly limited. Such a limited ridge clock washer is shown in FIG. 17.

In FIG. 17, and like the mounting plate shown in FIG. 8, the generally circular plate has lobed opposing ends 160*a, b*, a sloped perimeter 162 and a recessed central portion 164. Holes that are present central to the lobes that allow the passage of screws or bolts 166*a, b* therethrough. Such screws or bolts may be recessed into the lobes 160 or may protrude above the surface of the plate 126. Inside the central recessed portion is a central hole 168 through which a screw may pass to connect a vane or speed pod to the swim fin 106. Partially encircling the circumference of the central hole 168 and extending to the outward edges of the recess 164 is a partial clock washer structure 170 with alternating peaks 172 and troughs 174. This clock washer structure partially matches a similar structure in the attached vane or speed pod.

FIG. 16 shows the use of articulating attachments on the other side of a swim fin using clock washer mounting plates on both of its sides. The clock washers may be inherent or integral with the swim fin or may be present due to the use of mounting plates as previously described.

The pairs of mounting plates can be associated in a number of different manners. As there are three different kinds of mounting plates (full washer 128, terminal 146, and limited washer 126), these may be associated in pairs in as many as nine different combinations. For example, a 360° clock washer mounting plate 28 may be on one side of the swim fin with another 360° clock washer mounting plate on the other side. A 3-slot clock washer mounting plate 126 may be on one side and a 3-slot clock washer mounting plate on the other. Also a 3-slot clock washer mounting plate may be on one side with a 360° clock washer mounting plate on the other. Furthermore, a terminal mounting plate with no clock washer 146 may be on one side of the swim fin with either a 360° or a 3-slot clock washer mounting plate on the other.

When a swim fin has been fitted with the vane winglets 102 or whiskers as shown in FIG. 7, an increase propulsive power is supplied by the swim fin to the swimmer. As the winglets are angularly articulated about the bolt, the water flowing past the swim fin 106 is increasingly channeled towards the center of the fin. As more water is channeled toward the center of the fin by the winglets, it must flow faster across the fin in order to equalize the pressure applied by the fin to the surrounding water. As the water both flows faster across the fin and as the faster flow is channeled towards the center of the fin in a direction opposite to the fin, more propulsive power from the swimmer's kick is used to propel the swimmer rather than creating turbulence in the water about the fin.

While the present invention has been described with regards to particular embodiments, it is recognized that additional variations of the present invention may be devised without departing from the inventive concept.

What I claim is:

1. A swim fin having adjustable water-channeling vanes, comprising:

a swim fin blade, said blade having a first intermittent series of stop means comprising radial ridges circumscribing a central area, said blade defining a plane generally parallel to a wearer's foot;

a water-channeling vane, said vane having a second intermittent series of stop means complementary to said first intermittent series of stop means, said vane projecting generally perpendicular to said plane; and attachment means for attaching said vane to said blade, said attachment means providing pivotable articulation of said vane with respect to said blade; whereby said vane is securely but movably positionable with respect to said blade by engagement of said first intermittent series of stop means with said second intermittent series of stop means.

2. The swim fin of claim 1, wherein said radial ridges are angled with respect to said central area so that the height of said ridges closer to said central area is different from the height of said ridges farther from said central area.

3. The swim fin of claim 1, wherein said radial ridges are attachable to said blade.

4. The swim fin of claim 1, wherein said second intermittent series of stop means comprises radial ridges circumscribing a central area.

5. The swim fin of claim 4, wherein said radial ridges angle inwardly toward said central area so that the height of said ridges closer to said central area is lower than the height of said ridges farther from said central area.

6. The swim fin of claim 1, wherein said attachment means further comprises:

a bolt, said bolt travelling through a hole defined by said blade, said bolt protruding into a bore defined by said vane.

7. The swim fin of claim 6, wherein said first intermittent series of stop means circumscribe said hole and said second intermittent series of stop means circumscribe an opening to said vane bore.

8. The swim fin of claim 6, wherein said vane bore threadably engages said bolt.

9. A swim fin having adjustable water-channeling vanes, comprising:

a swim fin blade adapted to engage an extremity, said blade defining a hole therethrough, said hole circumscribed by a series of radial ridges angled with respect to a center of said hole, said blade defining a plane parallel to said extremity;

a water-channeling vane project generally perpendicular to said plane, said vane having an internal surface externally accessible through an aperture defined by said vane, said aperture circumscribed by a series of radial ridges angled with respect to a center of said aperture; and attachment means for attaching said vane to said swim fin, said attachment means providing pivotable articulation of said vane with respect to said swim fin; whereby said vane is securely but movably positioned with respect to said swim fin by engagement of said swim fin ridges with said vane ridges, said engagement of said ridges demanding a significant force to pivot said vane with respect to said swim fin, said force not exceeding that generally available from a swimmer's hand.

10. An adjustable, water-channelling vane for a swim fin, comprising:

a body defining a bore having an aperture;

means for channelling water protruding from said body said means for channeling water generally parallel to a major axis of said bore; and an intermittent series of stop means circumscribing said aperture comprising a series radial ridges angled with respect to a center of said aperture so that the height of said ridges closer said aperture center is different from the height of said ridges farther from said aperture center.

11. The adjustable, water-channelling vane of claim 10, wherein said bore is internally threaded.

12. An adjustable, water-channelling vane for a swim fin, comprising:

a body defining a bore having an aperture, said bore having an internal surface engageable by a bolt;

means for channelling water protruding from said body said means for channeling water generally parallel to a major axis of said bore; and a first series of radial ridges angled with respect to a center of said aperture so that the height of said ridges closer to said aperture center compares with the height of said ridges farther from said aperture center;

said first series of ridges engageable by a second series of ridges present on a swim fin blade, such engagement providing for secure but movably positioning of the vane with respect to said swim fin blade, said engagement of said ridges demanding a significant force to pivot the vane with respect to said swim fin, said force not exceeding that generally available from a swimmer's hand.

* * * * *